US007007518B1

(12) United States Patent
Taper

(10) Patent No.: US 7,007,518 B1
(45) Date of Patent: Mar. 7, 2006

(54) HANDCUFFS

(76) Inventor: William D. Taper, P.O. Box 518, Southern Pines, NC (US) 28388

( * ) Notice: Subject to any disclaimer, the term of this patent is extended or adjusted under 35 U.S.C. 154(b) by 0 days.

(21) Appl. No.: 11/007,451

(22) Filed: Dec. 8, 2004

Related U.S. Application Data

(63) Continuation-in-part of application No. 10/766,235, filed on Jan. 28, 2004, now Pat. No. 6,978,644, which is a continuation-in-part of application No. 10/394,668, filed on Mar. 21, 2003, now Pat. No. 6,684,666, which is a continuation-in-part of application No. 10/091,272, filed on Mar. 5, 2002, now Pat. No. 6,568,224.

(51) Int. Cl.
*E05B 75/00* (2006.01)

(52) U.S. Cl. ..... 70/16

(58) Field of Classification Search ..... 70/14–19
See application file for complete search history.

(56) References Cited

U.S. PATENT DOCUMENTS

| | | | | |
|---|---|---|---|---|
| 29,495 | A | 8/1860 | Kimball | |
| 33,917 | A | 12/1861 | Delestatius | |
| 35,578 | A | 6/1862 | Adams | |
| 130,872 | A | 8/1872 | Runquist | |
| 172,476 | A | 1/1876 | Palmer | |
| 200,950 | A | 3/1878 | Tower et al. | |
| 222,252 | A | 12/1879 | Daley | |
| 222,751 | A | 12/1879 | Tower et al. | |
| 268,171 | A | 11/1882 | Bean | |
| 268,496 | A | 12/1882 | Kahlke et al. | |
| 298,158 | A | 5/1884 | Bean | |
| 356,215 | A | 1/1887 | Tower | |
| 372,510 | A | 11/1887 | Bean | |
| 470,869 | A | 3/1892 | Kahlke | |
| 623,984 | A | 5/1899 | Cobb | |
| 636,589 | A | 11/1899 | Tower | |
| 686,626 | A | 11/1901 | Maltby | |
| 732,417 | A | 6/1903 | Judd | |
| 766,263 | A | 8/1904 | Judd | |
| 772,468 | A | 10/1904 | Maltby | |
| 1,000,666 | A | 8/1911 | Caveney | |
| 1,157,135 | A | 10/1915 | Wesson et al. | |
| 1,161,562 | A | 11/1915 | Wesson | |
| 1,509,335 | A | 9/1924 | Bockin | |
| 1,579,333 | A | 4/1926 | Neal | 70/16 |
| 1,775,727 | A | 9/1930 | Latou | |
| 1,845,511 | A | 2/1932 | Neal | |
| 1,856,427 | A | 5/1932 | Pratt | 70/16 |
| 1,872,857 | A | 8/1932 | Wesson et al. | |
| 1,881,577 | A | 10/1932 | Hillyard | |
| 1,890,748 | A | 12/1932 | Pratt | 70/16 |
| 1,900,242 | A | 3/1933 | Latou | |
| 1,984,677 | A | 12/1934 | Harrington | |
| 2,390,885 | A | 12/1945 | Kelley | 70/16 |
| 2,510,294 | A | 6/1950 | Rivolier | 70/16 |
| 3,392,554 | A | 7/1968 | Williamson | 70/16 |

(Continued)

*Primary Examiner*—Suzanne Dino Barrett
(74) *Attorney, Agent, or Firm*—Thomas R. Weaver

(57) ABSTRACT

An apparatus for controlling the rotation of a gear comprising rotating a cam which causes the linear movement of a rod to control the rotation of the gear, wherein the cam rotates within a confined space but not around a fixed axle. The apparatus is particularly useful for controlling the opening and closing movements of a handcuff whose operating elements are comprised of a swing arm and at least one gear having teeth which engage the teeth of the swing arm.

14 Claims, 8 Drawing Sheets

U.S. PATENT DOCUMENTS

| | | | | |
|---|---|---|---|---|
| 3,616,665 | A | 11/1971 | Rosenthal | 70/16 |
| 3,618,345 | A | 11/1971 | Smith | 70/16 |
| 4,287,731 | A | 9/1981 | Kruger | 70/16 |
| 4,314,466 | A | 2/1982 | Harris | 70/16 |
| 4,509,346 | A | 4/1985 | Szczepanek | 70/16 |
| 4,574,600 | A | 3/1986 | Moffett | 70/16 |
| 4,694,666 | A | 9/1987 | Bellingham et al. | 70/16 |
| 5,138,852 | A | 8/1992 | Corcoran | 70/16 |
| 5,598,723 | A | 2/1997 | Ecker et al. | 70/16 |
| 5,697,231 | A | 12/1997 | Tobin et al. | 70/16 |
| 5,797,284 | A | 8/1998 | Lurie | 70/16 |
| 6,311,529 | B1 | 11/2001 | Kang | 70/16 |
| 6,568,224 | B1 * | 5/2003 | Taper et al. | 70/16 |
| 6,574,998 | B1 * | 6/2003 | Kwon | 70/16 |
| 6,629,440 | B1 * | 10/2003 | Meekma et al. | 70/49 |
| 6,684,666 | B1 * | 2/2004 | Taper | 70/16 |
| 6,851,284 | B1 * | 2/2005 | Kim et al. | 70/16 |

* cited by examiner 4
26
38
31
37
31
44
43
45

A
31
41
31a
38
38b
46
43a
42
28b
24a
5
5
37
32
43
31b 23a
44
46
49
34
35
36
33
26
26a
6
6
40
38a
38
47
33a
48
50
39
51
51
A
33

HANDCUFFS

This is a continuation-in-part of U.S. application Ser. No. 10/1766,235 filed Jan. 28, 2004, now U.S. Pat. No. 6,978, 644, which is a continuation-in-part of application Ser. No. 10/394,668, filed Mar. 21, 2003, now U.S. Pat. No. 6,684, 666 issued Feb. 3, 2004, which is a continuation-in-part of application Ser. No. 10/091,272, filed Mar. 5, 2002, now U.S. Pat. No. 6,568,224 issued May 27, 2003.

BACKGROUND OF THE INVENTION

1. Technical Field of the Invention.

This invention broadly relates to locking devices. The invention further relates to locking devices useful to physically restrain the movement by an individual of his or her arms and/or legs. This invention more particularly relates to mechanical restraining devices referred to in the art as "handcuffs." This invention specifically relates to an operating and a locking mechanism for a handcuff.

2. Description of the Prior Art and Problems Solved.

It is known in the art that a handcuff is an apparatus which is ordinarily placed around the wrist or ankle of an individual. The apparatus is usually directly connected to another such device by a bridge, such as a chain, a link, or a bar, to thereby form a combination of such devices. The combination is referred to in the art as "handcuffs" or as a "set of handcuffs."

It is known in the art to place handcuffs upon an individual to render such individual physically ineffective or powerless. Accordingly, handcuffs can be employed in the field of law enforcement for the purpose of physically restraining an individual from escape and/or to prevent such restrained individual from injuring himself and/or some other person, such as a police officer. It is apparent that a handcuff, or handcuffs, which can be opened and removed by the person being restrained, or by any other unauthorized person, either by force or by device defeats the purpose of the handcuffs.

A handcuff described in prior work of the applicant herein contains mechanisms which function to permit the apparatus to open and to close and also function to prevent the apparatus from opening. The first function is referred to as the "operating mechanism." The second function is referred to as the "locking mechanism."

An example of a handcuff previously described by applicant is an apparatus comprised of a combination of at least two, and sometimes three, planar, substantially parallel, plates and a movable arm. The plates and movable arm cooperate to produce a ring defined as a "restraining space" which can be opened and closed. It is to be understood that the wrist or ankle of the individual to be restrained is placed and confined in the restraining space.

The combination of plates is a sandwich structure comprised of two, aligned, exterior plates which cooperate to form a stationary arm and an enclosed interior space. The enclosed interior space is referred to as the "machinery space." The machinery space can sometimes be further defined by holes and cavities formed in a third plate positioned between the two exterior plates. The third plate separates the exterior plates and provides spaces in which the operating and locking mechanisms are positioned.

Each exterior plate is ordinarily a unitary body comprised of a first section, referred to as a "cheek plate," and a second section, referred to as a "plate arm." The cheek plates serve as the top and bottom covers of the machinery space and as a base to support the operating and locking mechanisms positioned in the machinery space. The plate arms combine to form the mentioned stationary arm.

Each plate arm, which extends beyond the cheek plate to form one side of the stationary arm, is a rigid, curvilinear, i.e., a "C-shaped," member which terminates at an end adapted for hinged attachment to the movable arm. The stationary arm, formed by the combination of the aligned, curvilinear, plate arms, is referred to as such to distinguish the combination of plate arms from the movable arm of the handcuff. The combination of the terminal ends of each plate arm is referred to as the hinge end of the stationary arm.

The movable arm of a handcuff, which is referred to as a swing arm, is also a rigid, curvilinear member having a pivot end and a free end. The pivot end of the swing arm is positioned between the terminal ends of each plate arm and is rotatably connected to the hinge end of the stationary arm. The free end of the swing arm is equipped with teeth adapted to engage, that is, contact and intermesh with, opposing teeth mounted within the machinery space.

Accordingly, in operation, the pivot end of the swing arm and the hinge end of the stationary arm cooperate to permit the free end of the swing arm to rotate into at least a portion of the machinery space wherein the teeth on the free end of the swing arm engage teeth mounted within the machinery space to thereby form the restraining space.

In handcuffs known in the art prior to the work of applicant, the restraining space is opened by causing the teeth of the swing arm to disengage from the teeth in the machinery space followed by rotating the swing arm out of the machinery space. Thus, the operating mechanism of handcuffs known in the art prior to the disclosure of U.S. Pat. No. 6,568,224 features a substantially linear member enclosed in the machinery space having a plurality of teeth mounted on one side thereof which are adapted to engage teeth on the swing arm. The linear member is hinged at one end and biased to urge the teeth on the linear member into engagement with the teeth on the swing arm. The mechanism has been characterized as a hinged pawl situated within the machinery space of the handcuff. The swing arm must enter the machinery space to form, i.e. close, the restraining space. Accordingly, the swing arm is rotated into the machinery space with force sufficient to overcome the resistance of the biasing source to cause the pawl to rotate about the hinge. The result of this action is to raise the teeth on the pawl out of engagement with the teeth on the swing arm. The operating mechanism employs a reciprocating action wherein teeth on the pawl and teeth on the swing arm are continually alternating between an engaged and a disengaged condition as the swing arm is rotated into the machinery space. This operating mechanism is referred to as the ratchet and pawl mechanism.

U.S. Pat. No. 6,568,224, a parent of the present invention provides a handcuff having an operating mechanism which is at all times in full contact and intermeshed with teeth on the swing arm when the handcuff is being either opened or closed, and it also provides a handcuff having a locking mechanism which can permit or prevent movement of the operating mechanism.

The '224 patent discloses a handcuff comprised of a housing having an operating and a locking mechanism enclosed therein. The housing is comprised of at least two, substantially identically shaped, opposed, substantially parallel plates and a swing arm. Each plate is a unitary body having an inside surface, an outside surface, an arm side and an open side, and each plate is divided into a first section, referred to as a "cheek plate," and a second section referred to as a "plate arm." A plate arm is a narrow, elongated, curvilinear part of the plate which extends in an arc from the arm side of the plate to a terminal end on the open side of the plate. The plates are spaced apart to provide a machinery space between the opposed inside surfaces of each cheek plate and a curvilinear stationary arm defined by the spaced, opposed plate arms. The space between the terminal ends of the plate arms is referred to as the hinge end of the stationary arm.

The swing arm, like the stationary arm, is also a narrow, elongated curvilinear body having a pivot end and a free end. The pivot end of the swing arm is positioned between the terminal ends of the plate arms and rotatably connected to the hinge end of the stationary arm. The swing arm extends in an arc toward the open side of each plate from the hinge end of the stationary arm to the free end of the swing arm. The free end of the swing arm is equipped with teeth adapted to engage, that is, contact and intermesh with, opposing teeth mounted within the machinery space.

The swing arm, the stationary arm, and the inner edges of the opposed cheek plates cooperate to form the restraining space of the handcuff when the free end of the swing arm is rotated into and engaged with teeth mounted in the machinery space.

The operating mechanism of the handcuff disclosed in the '224 patent is housed in the machinery space between the opposed cheek plates. The operating mechanism can be a single toothed wheel, that is, a gear, whose teeth engage the teeth mounted on the swing arm. The operating mechanism can be comprised of two gears, each of whose teeth can simultaneously engage the teeth mounted on the swing arm. The operating mechanism can be comprised of an array of three intermeshing gears having two gears, referred to as "working gears," whose teeth simultaneously engage the teeth mounted on the swing arm, and a third gear, referred to as an "idler gear," whose teeth are continually engaged with the teeth on at least one working gear and can be continually engaged with the teeth on the two working gears. When the handcuff is being opened or closed, that is, when the restraining space is being opened or closed, teeth mounted on the swing arm are always in contact with teeth on at least one of the working gears. Thus, gear teeth engage teeth of the swing arm when the swing arm is in the closed position and not moving, when the swing arm is being rotated toward the open side of the plates to place the handcuff into the closed position and when the swing arm is being rotated away from the open side of the plates to place the handcuff in an open position.

Any working gear of the operating mechanism having teeth engaged with teeth on the swing arm must rotate to enable any movement of the swing arm. Accordingly, the handcuff of the '224 patent also provides a multi-function locking mechanism which controls the rotation of the gears. The locking mechanism is housed in the machinery space between the opposed cheek plates in a location separate from the operating mechanism. In a first locking position referred to as the "closing position," the locking mechanism is positioned to permit rotation of the gears in one direction to permit closing rotation of the swing arm, and to prevent rotation of the gears in the opposite direction to prevent opening rotation of the swing arm. In a second locking position referred to as the "locked position," the locking mechanism is positioned to prevent any rotation of the gears in any direction to prevent any rotation of the swing arm in any direction. In a third locking position referred to as the "free position," the locking mechanism is positioned to permit rotation of the gears in any direction to permit rotation of the swing arm in any direction.

The operating mechanism of the handcuff of the '224 patent is broadly comprised of a first working gear and a swing arm. The first working gear is rotatably mounted on a first gear axle which is perpendicularly attached to a fixed planar base, and the swing arm is rotatably mounted on a swing arm axle which is also perpendicularly attached to the planar base.

The operating mechanism of the handcuff of the '224 patent can further include a control pin comprising a linear rod slidably mounted on, and parallel to, the fixed planar base in a position opposed to the first working gear and preferably perpendicular to the first gear axle. The rod has a proximal end, a distal end and a biasing means, such as spring, abutting the distal end of the rod to urge the proximal end of the rod into contact with the teeth on the first working gear. The proximal end of the rod is adapted to contact the teeth on the first working gear to permit rotation of the first working gear around the first axle in one rotational direction while preventing rotation of the first working gear around the first axle in the opposite rotational direction.

The operating mechanism of the handcuff of the '224 patent cooperates with a locking mechanism which converts rotational motion to linear motion. The locking mechanism is comprised of a cam in operable combination with a cam follower, referred to as a cam lever, which is perpendicularly and rigidly attached to the mentioned linear rod of the control pin at a point intermediate the proximal end and the distal end of the linear rod.

The cam of the handcuff of the '224 patent is a plate having a hole in one end, referred to as the axle end, and a forked end linearly spaced apart from the axle end. The cam is referred to as a yoke. The axle end of the yoke is closed and rotatably mounted on a yoke axle. The forked end of the yoke is open having a first leg on one side of the opening and a second leg on the opposite side of the opening side. The second leg is spaced apart from the first leg.

The yoke axle is perpendicularly fixed to the planar base. The axle end of the yoke is rotatably mounted on the yoke axle so that the cam lever on the control pin is situated between the first leg and the second leg of the forked end of the yoke. The yoke rotates around the yoke axle in a plane parallel to the planar base. Rotation of the yoke around the yoke axle in one rotational direction causes contact between the cam lever and the inside surface of the first leg to thereby linearly urge the rod against the biasing means at the distal end of the rod. Rotation of the yoke around the yoke axle in the opposite rotational direction causes contact between the cam lever and the inside surface of the second leg to thereby linearly urge the proximal end of the rod against the teeth of the first working gear.

The locking mechanism of the handcuff of the '224 patent can be further comprised of a means for rotating the yoke on the yoke axle and detent means for maintaining the position of the yoke with respect to the cam lever in either the closing position or the locked position.

U.S. Pat. No. 6,568,224 discloses an operating mechanism featuring a control pin which directly contacts a working gear. Also illustrated is an embodiment featuring an array of three intermeshing gears consisting of two working gears and one idler gear. U.S. Pat. No. 6,684,666, a parent of the present application, discloses an operating mechanism featuring a control pin which directly contacts the idler gear.

The cam employed in the disclosures of the '224 patent and the '666 patent is an oval plate in the shape of a yoke having a closed end and an open end. The oval plate is positioned in a cavity of the machinery space. A key is employed to rotate the plate around the yoke axle to position the control pin in a desired location. The yoke axle is not placed in the center of the cavity. Accordingly, the eccentric position of the yoke axle requires a cavity much larger in size than the cam to enable rotational movement of the cam.

U.S. application Ser. No. 10/766,235, a parent of the present invention, discloses a handcuff having an electro-mechanical locking mechanism which can be remotely operated with an electronic key to control the rotation of a gear around a gear axle, i.e., a hub. The handcuff of application Ser. No. 10/766,235 comprises a bi-directional solenoid, having an associated power source and a UHF receiver, a cam, and an accutation arm. The cam is moved by the bi-directional solenoid. The solenoid and cam, in combination with a UHF RF transmitter, permit the handcuff to be locked and unlocked electronically. The use of a mechanical key is not required, but may be employed.

The cam and actuation arm operate in combination to linearly move a control rod which is adapted to contact the teeth of the gear.

The cam is a flat, substantially circular, plate which is rotatably attached to an axle. The axle, referred to as the cam axle, is perpendicularly fixed to a planar base. The cam is adapted to rotate around the cam axle in a plane which is parallel to the base. The gear hub, mentioned above, is, preferably, perpendicularly fixed to the same planar base as the cam axle. The gear is adapted to rotate around the hub in a plane which is parallel to the base. The circular cam is positioned in a circular cavity in the machine space. The cam axle is substantially centered in the circular cavity.

The actuation arm is comprised of a cylinder and a housing. The hollow interior of the housing contains at least one coil of the type adapted to conduct an electric current. The cylinder includes a plunger adapted to longitudinally slide within the coils in the hollow interior of the housing. The plunger slides within the coils upon passage of an electric current through the coils. Linear movement of the plunger operates to cause the cam to rotate.

THE INVENTION

This invention provides a handcuff having at least one gear, a swing arm, a control rod, and a rod cam. The teeth on the gear remain constantly intermeshed with the teeth on the swing arm while the handcuff is in the closed position or is being opened or is being closed.

The gear is rotatably attached to an axle, which is perpendicularly affixed to a planar base. The gear rotates around the axle in a plane parallel to the planar base in response to rotation of the swing arm, which is also rotatably attached to the planar base.

The control rod is slidably mounted on the planar base, and is adapted to control the rotation of the gear. In this regard, the control rod is equipped with a tip end which, in one mode, can be positioned to contact the gear to enable the gear to rotate in the closing direction, but not in the opening direction. In another mode, the tip end of the rod can be positioned to avoid contact with the gear to enable the gear to rotate in the closing direction and in the opening direction. In still another mode, the tip can be positioned to contact the gear to prevent the gear from rotating in any direction.

The rod cam controls the position of the tip end of the control rod relative to the gear. The cam is confined to, and rotates within, a cam space which abuts the planar base. The cam rotates in a plane parallel to the planar base, but it does not rotate around an axle attached to the planar base.

The rod cam is comprised of a cam plate and a cam shaft. The cam plate is substantially circular in shape; it includes a top surface, a bottom surface and a set of shoulders. Rotation of the cam causes the shoulders to contact and slide the control rod on the planar base to position the tip end of the control rod with respect to the gear. The cam shaft perpendicularly extends from the top surface of the cam plate and can perpendicularly extend from the top and bottom surface of the cam plate. The cam plate and cam shaft interact to cause the cam plate to rotate within the cam space upon rotation of the cam shaft.

The handcuff can have any number of gears, but it must have at least one gear. In an embodiment having a single gear, the single gear is a working gear; that is, the teeth of the working gear intermesh with the teeth of the swing arm. The handcuff can have two working gears. The handcuff can have a single working gear and an idler gear, wherein the teeth of the idler gear intermesh with the teeth of the working gear, but not with the teeth of the swing arm. In another embodiment, the handcuff can have two working gears and a single idler gear. The control rod can contact a working gear or an idler gear to control the rotation of all gears.

BRIEF DESCRIPTION OF THE DRAWINGS

FIG. 3 shows the machinery space, and a partial view of the swing arm.

DESCRIPTION OF THE PREFERRED EMBODIMENTS

Figures 1, 2:
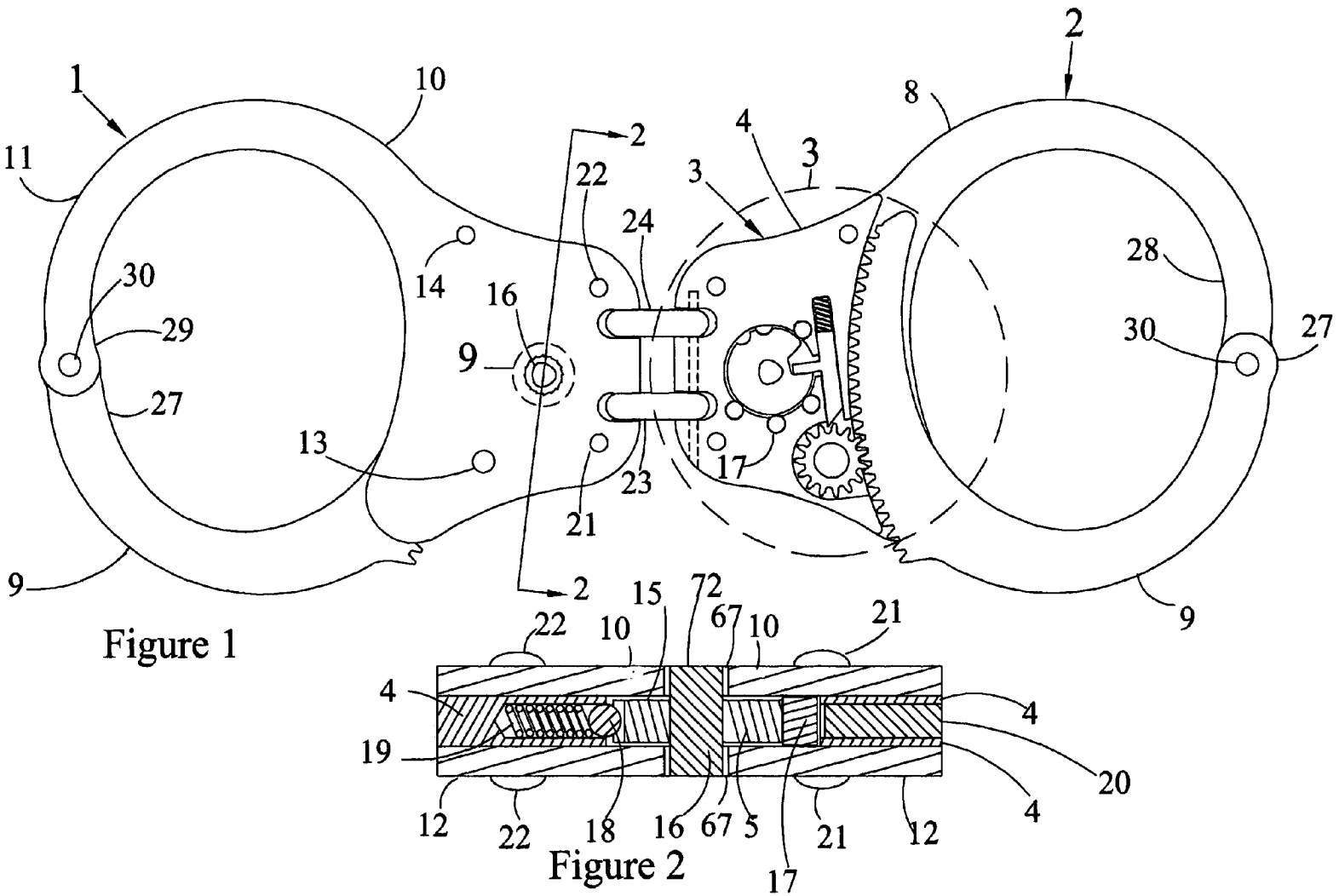
FIG. 1 is a plan view of a set of handcuffs. The view of the left handcuff shows the outer surface of the top cheek plate and plate arm and a partial view of the swing arm. The view of the right handcuff does not show the top cheek plate in order to expose the machinery space and the contents thereof. The swing arm engaged with a gear in the machinery space and a partial view of the inner surface of the bottom plate arm is also shown.
FIG. 2 is a section view of the left handcuff of FIG. 1 taken in the direction of cut line 2—2.
Figure 3:
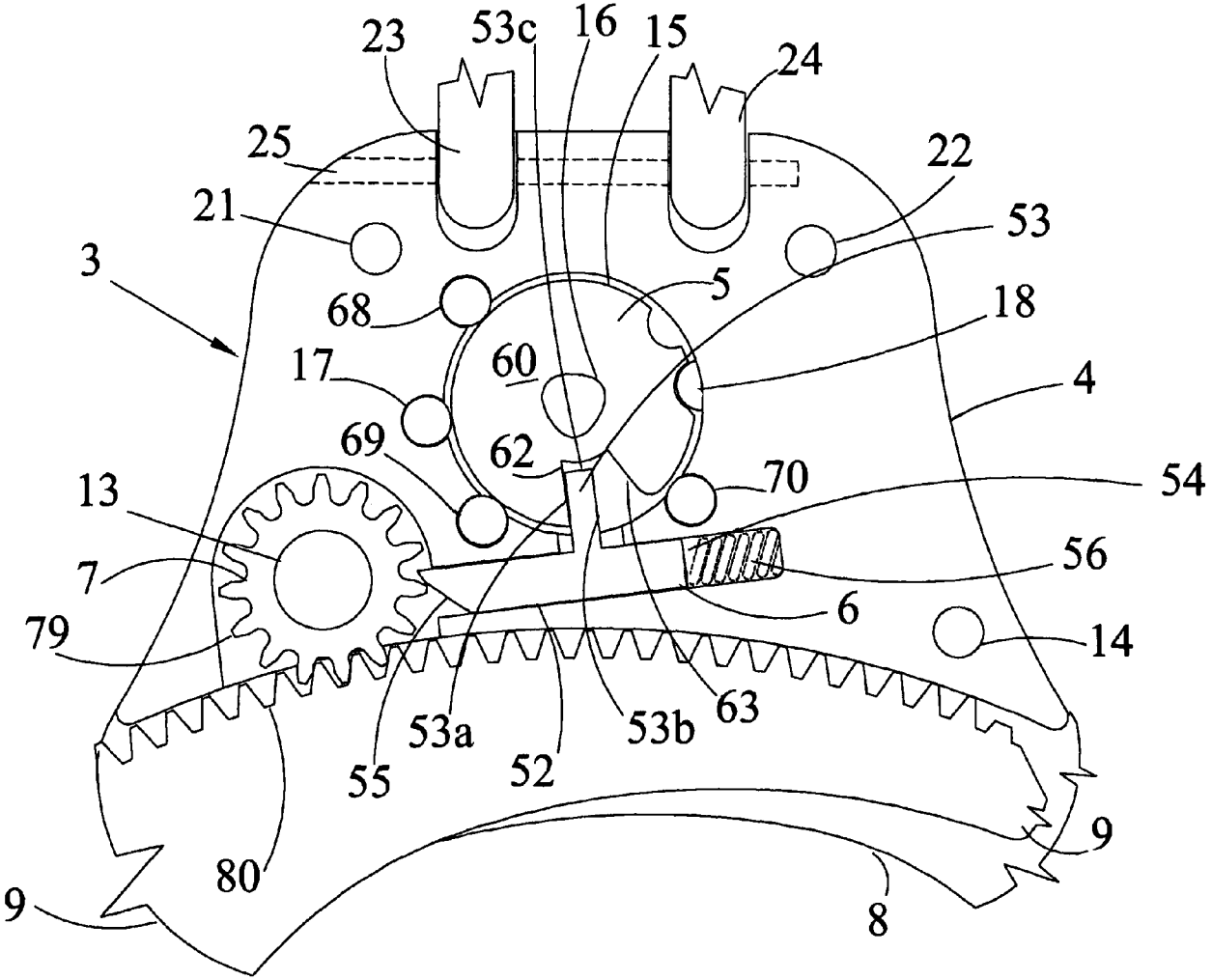
FIG. 3 is an enlarged view of the right handcuff of FIG. 1 lying within circle 3.

Referring now to FIGS. 1, 2 and 3, a set of handcuffs is shown consisting of left handcuff 1 and right handcuff 2. Handcuff 1 and handcuff 2 are identical, accordingly, unless specifically stated to the contrary, a reference numeral made with reference to one of the two handcuffs applies to the other.

Top cheek plate 10 and plate arm 11 of right handcuff 2 are not shown in order to reveal machinery space 3 consisting of machinery housing 4 which contains rod cam 5, control rod 6 and working gear 7. The view of right handcuff 2 also shows the inside surface of plate arm 8 and swing arm 9.

The view of the left handcuff 1 shows the outside surface of top cheek plate 10, plate arm 11 and a partial view of swing arm 9. FIG. 2, a section view of left handcuff 1, shows top cheek plate 10, bottom cheek plate 12, machinery housing 4, gear axle 13, rivets 21 and 22 and rod cam 5 consisting of cam plate 15 and cam shaft 16. FIG. 2 also shows dowel 17, detent ball 18, detent spring 19, and plug 20.

Machinery housing 4 is located between, and rigidly connected to, top cheek plate 10 and bottom cheek plate 12 by rivets 14, 21 and 22.

Figures 4, 5, 6:
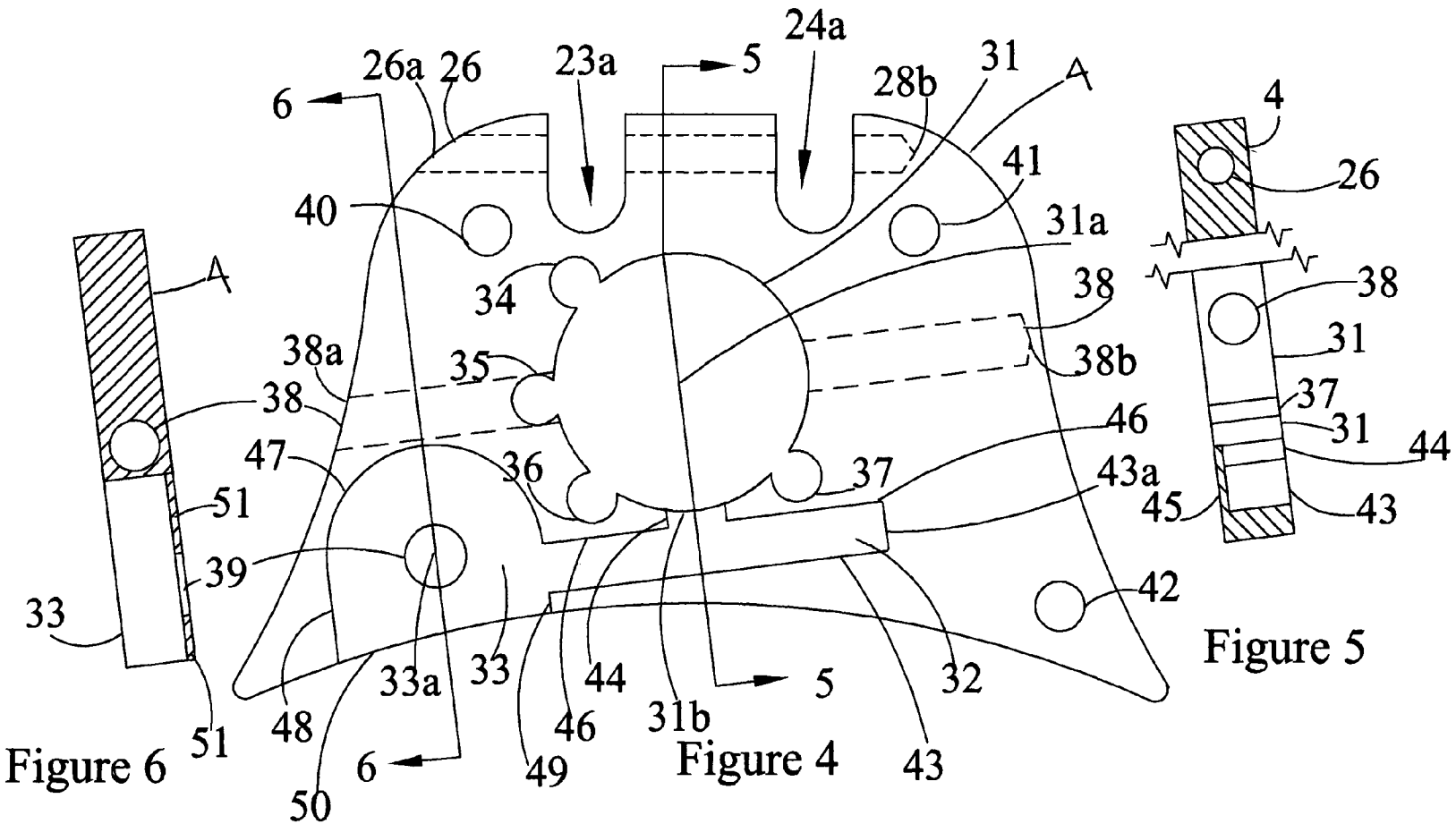
FIG. 4 is a plan view of the machinery block of FIG. 3 situated between the inner surfaces of the top cheek plate and the bottom cheek plate of the right handcuff.
FIG. 5 is a section view of the machinery block shown in FIG. 4 taken in the direction of cut line 5—5.
FIG. 6 is a section view of the machinery block shown in FIG. 4 taken in the direction of cut line 6—6.

Left handcuff 1 and right handcuff 2 are connected by links 23 and 24. Links 23 and 24 are fastened to the cuffs by pin 25 which passes through holes drilled (not show) in links 23 and 24. As shown in FIG. 4, pin 25 is contained in hole 26 drilled in machinery housing 4. Link 23 is positioned in open slot 23*a* cut in machinery housing 4 and aligned slots (not shown) cut in cheek plates 10 and 12. Link 24 is positioned in open slot 24*a* cut in machinery housing 4 and slots (not shown) cut in cheek plates 10 and 12.

Hinge end 27 of swing arm 9 is rotatably connected to end 28 of plate arm 8 and end 29 of plate arm 11 by pin 30.

Referring now to FIGS. 4, 5 and 6, machinery housing 4 is comprised of cam space 31, control rod cavity 32 and gear cavity 33. Machinery housing 4 also includes dowel holes 34, 35, 36 and 37, and drilled holes 38, 39, 40, 41 and 42.

Cam space 31 is substantially circular in shape. It completely penetrates the entire thickness of machinery housing 4 to enable unobstructed access between the inside surface of top cheek plate 10 and bottom cheek plate 12. As seen in FIG. 4, dowel holes 34, 35, 36 and 37 completely penetrate the entire thickness of machinery housing 4 and are spaced around the perimeter of cam space 31. Holes 34, 35 and 36 are all positioned on one of the semicircular sides of cam space 31 and hole 37 is placed on the other. The radius of each dowel hole is substantially less than the radius of cam space 31. In addition, the distance from center 31*a* of cam space 31 to the center of any particular dowel hole is less than the sum of the radius of cam space 31 and the radius of the dowel hole. As a result, the perimeter of each of dowel holes 34, 35, 36 and 37 intersects the perimeter of cam space 31. It is preferred that the distance from cam space to 31 to the center of each of dowel holes 34, 35, 36 and 37 is identical and that the radius of each dowel hole is the same. Furthermore, it is preferred that the center of each dowel hole is spaced at least about 45 degrees apart from the immediately adjacent dowel hole. Thus, as seen in FIG. 4, dowel hole 35 is separated from dowel hole 34 by about 45 degrees and from dowel hole 36 by about 45 degrees. Dowel hole 36 is separated from dowel hole 37 by about 90 degrees, and dowel hole 34 is separated from dowel hole 37 by about 180 degrees.

Control rod cavity 32 intersects cam space 31 and gear cavity 33. Cavity 32 is comprised of two intersecting linear slots 43 and 44. Slots 43 and 44 do not penetrate the entire thickness of machinery housing 4. Accordingly, the top surface of machinery housing 4 is penetrated, but the bottom surface is not, thereby forming shelf 45 under each of slots 43 and 44. Slot 43 intersects gear cavity 33, wherein edge 46 of slot 43 is substantially perpendicular to center 33*a* of gear cavity 33. Slot 44 intersects cam space 31 at a position intermediate dowel hole 36 and dowel hole 37, wherein the linear axis of slot 44 is substantially perpendicular to center 31*a* of space 31.

Gear cavity 33 comprises a first portion having a single curvilinear edge 47 and a second portion having parallel linear edges 48 and 49. Curvilinear edge 47 is substantially a semicircle whose center of rotation is center 33*a* of cavity 33. Edge 47 terminates at two points. In one instance edge 47 terminates and edge 49 begins at the point of intersection of edge 46. In the second instance edge 47 terminates and edge 48 begins at the point of intersection of the extension of edge 46 through center 33*a* of cavity 31. Each of parallel edges 48 and 49 terminates at lower edge 50 of machinery housing 4. It is shown in FIG. 4 that slot 44 intersects cam space 31 at edge 31*b* of cam space 31.

Gear cavity 33 does not penetrate the entire thickness of machinery housing 4. The top surface of machinery housing 4 is penetrated, but the bottom surface is not, thereby forming shelf 51 under cavity 33. Center 33*a* of cavity 31 is also the center of gear axle hole 39 which penetrates shelf 51.

Closed linear hole 38 begins at open end 38*a*, penetrates the edge of machinery housing 4 at gear cavity 33, and proceeds in a direction perpendicular to center 31*a* of cam space 31. Hole 38 passes through dowel hole 35, continues at the opposite perimeter edge of machinery housing 4 and terminates at closed end 38*b* without penetrating the opposite edge of machinery housing 4. Linear hole 38 lies between the top and bottom surfaces of machinery housing 4.

Closed linear hole 26 begins at open end 26*a* and continues to closed end 28*b*. Hole 26 is perpendicular to slots 23*a* and 24*a*.

Refer to FIGS. 3–8 and note that rod cam 5 is rotatably positioned in cam space 31; control rod 6 is positioned in control rod cavity 32; and working gear 7 is positioned in gear cavity 33. Control rod 6 is comprised of linear pin 52 and cam lever 53. Linear pin 52 includes distal end 54 and proximal end 55. Cam lever 53 is a linear element which is perpendicularly and rigidly attached to pin 52 intermediate distal end 54 and proximal end 55. Cam lever 53 includes free side 53*a*, locked side 53*b* and top side 53*c*.

Control rod 6 is slidably positioned in rod cavity 32 so that distal end 54 extends into closed end 43*a* of slot 43, top side 53*c* of lever 53 extends into cam space 31, and proximal end 55 is enabled to extend into gear cavity 33. Biasing spring 56 is placed in closed end 43*a* of slot 43 intermediate distal end 54 of pin 52 and the terminus of slot 43. Spring 56 functions to urge proximal end 55 into cam space 31. Control rod 6 is slidably supported in machinery housing 4 by shelf 45.

As previously mentioned, rod cam 5 is substantially circular in shape and is comprised of cam plate 15 and cam shaft 16. Cam plate 15 is comprised of cam lever slot 57, locking detent 58, closing detent 59, ramp 65 and curve 66. Cam plate 15 has a planar top surface 60 and a planar bottom surface 61.

Cam lever slot 57, which consists of free side 62, locked side 63 and bottom 64, is a substantially rectangular opening formed in the edge of plate 15. Locking detent 58 and closing detent 59 are concavities formed in the edge of plate 15, wherein detent 59 is positioned between locked side 63 of slot 57 and detent 58. Ramp 65 is a convex surface joining the edge of plate 15 and detent 59. Curve 66 is a convex surface joining the edge of plate 15 and locked side 63 of slot 57.

The diameter of cam plate 15 is less than the diameter of cam space 31 to thereby enable plate 15 to be placed and rotate in space 31. Dowels 17, 68, 69 and 70 are positioned to substantially maintain center 15*a* of cam plate 15 in alignment with center 31*a* of cam space 31, and to minimize friction between the perimeter of cam plate 15 and the edge of cam space 31 as cam plate 15 rotates in cam space 31.

Figure 9:
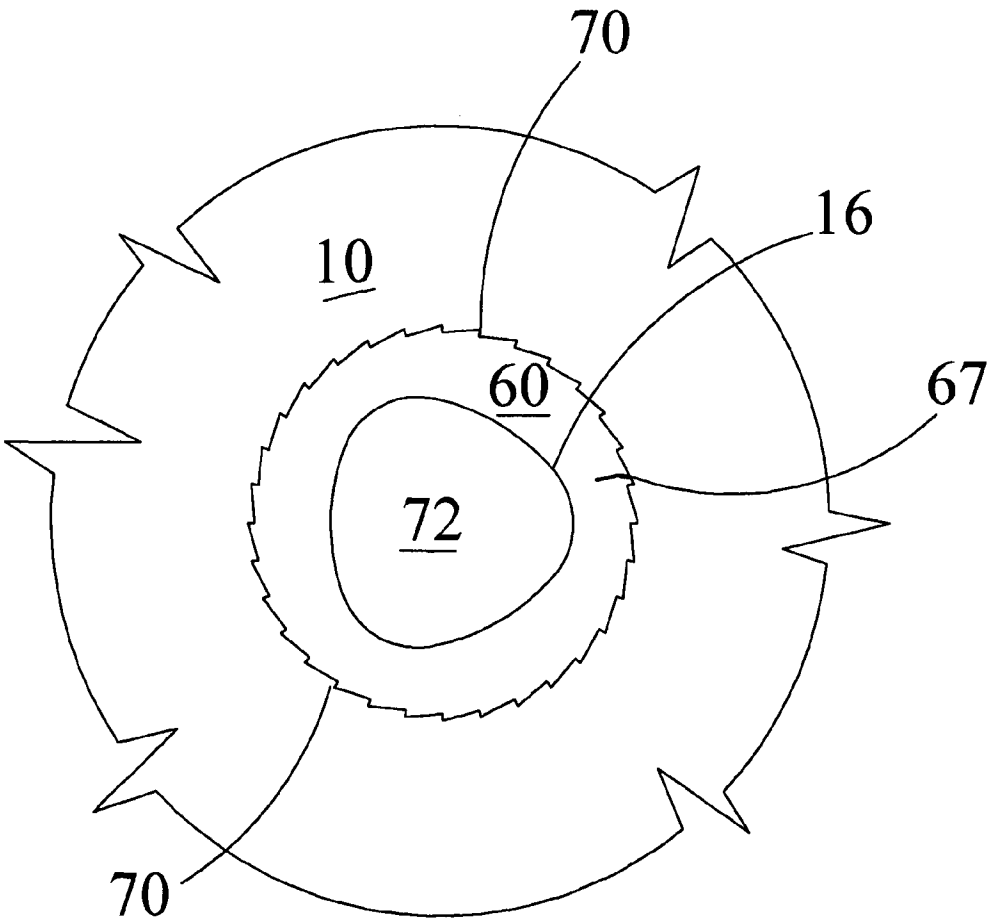
FIG. 9 is an enlarged view of the left handcuff of FIG. 1 lying within circle 9 showing the keyhole element.

Cam shaft 16 is a rigid linear element which is perpendicular to at least one planar surface of plate 15, such as top surface 60 of cam plate 15. Shaft 16 is shaped to prevent rotation of plate 15 around shaft 16 and to cause plate 15 to rotate upon rotation of shaft 16. In one embodiment, shaft 16 is rigidly attached to cam plate 15. As shown in FIGS. 2 and 9, shaft 16 extends through key hole 67 bored in cheek plates 10 and 12.

Figure 8:
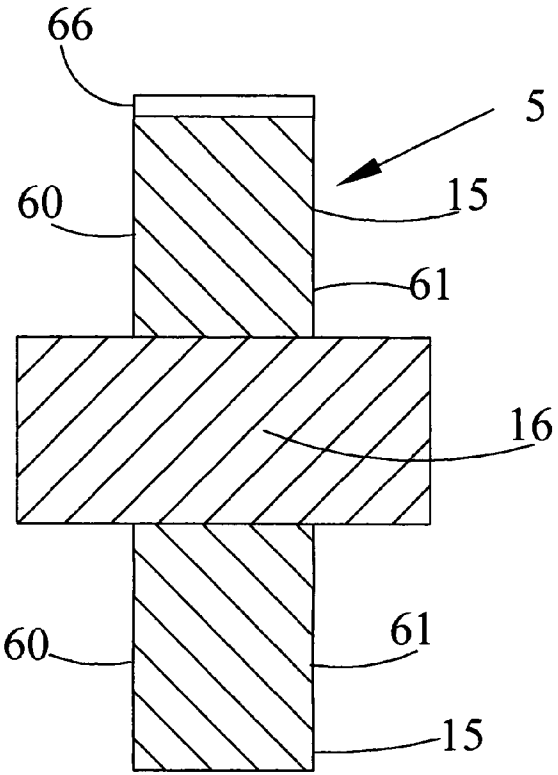
FIG. 8 is a section view of the rod cam shown in FIG. 7 taken in the direction of cut line 8—8.
Figure 7:
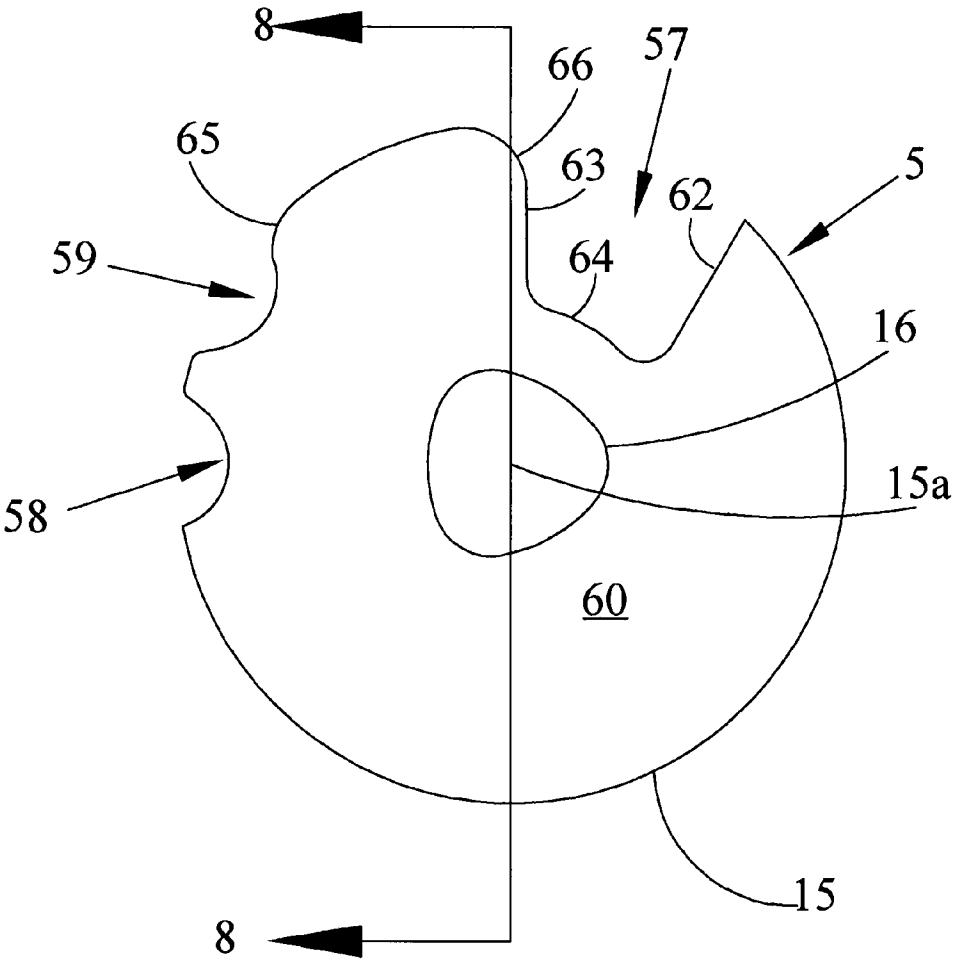
FIG. 7 is a plan view of the rod cam.

As shown in FIGS. 7 and 8, cam shaft 16 has an irregular horizontal cross section. More specifically, the horizontal cross section of shaft 16 is triangular in shape, wherein the vertices of the triangle are curved lobes. Shaft 16 is fixed in a hole drilled entirely through cam plate 15. The shape of the hole in plate 15 is identical to the horizontal cross section of shaft 16. Accordingly, shaft 16 does not rotate in the hole formed in plate 15. As shown in FIG. 2, shaft 16 perpendicularly extends beyond top surface 60 and bottom surface 61 of plate 15 through key hole 67 drilled in cheek plate 10 and a hole drilled in cheek plate 12. The top and bottom surfaces of shaft 16 are, preferably, in alignment with the upper surfaces of cheek plates 10 and 12, respectively.

As shown in FIGS. 3 and 4, dowels 17, 68, 69 and 70 are positioned in dowel holes 35, 34, 36 and 37, respectively. As shown in FIG. 2, detent spring 19 is placed in closed end 38*b* of drilled hole 38 and detent ball 18 is positioned in hole 38 intermediate detent spring 19 and cam space 31. Plug 20 is positioned in the open end of hole 38 and operates to close the open end of hole 38 and to maintain dowel 17 in hole 35.

An arcuate portion of each one of dowels 17, 68, 69 and 70 extends into cam space 31. The height of each dowel is equal to the thickness of machinery housing 4.

Detent spring 19 operates to force detent ball 18 into cam space 31 against the edge of cam plate 15. The diameter of detent ball 18 is less than the thickness of machinery housing 4 and is sized to enable detent ball 18 to slide in and out of hole 38.

Dowels 17, 68, 69 and 70 and detent ball 18 are in constant contact with the edge of cam plate 15.

As mentioned, rod cam 5 is positioned in cam space 31 wherein it is adapted to rotate in a plane parallel to cheek plates 10 and 12. In this regard, cam 5 is positioned in space 31 to enable cam lever 53 to extend into cam slot 57 so that free side 53*a* of lever 53 is adjacent to free side 62 of slot 57, locked side 53*b* of lever 53 is adjacent to locked side 63 of slot 57 and top side 53*c* of lever 53 does not contact bottom 64 of slot 57.

The handcuff, as shown in FIG. 3, is in the closing position. As shown in FIG. 3, the edge of rod cam 5 is in tangential contact with dowels 17, 68, 69 and 70. Detent ball 18 is pushed into closing detent 59 by spring 19, and free side 53*a* of lever 53 is in contact with free side 62 of slot 57. Dowels 17, 68, 69 and 70 and detent ball 18 cooperate to substantially maintain center 15*a* of cam plate 15 in alignment with center 31*a* of cam space 31.

Working gear 7 is positioned and supported on shelf 51 under cavity 33 and is rotatably mounted on axle 13 which passes through hole 39 and is perpendicularly affixed to cheek plates 10 and 12. As shown in FIG. 3, the teeth of gear 7 interact with proximal end 55 of pin 52. Proximal end 55 is bevel-shaped to permit gear 7 to turn in the counter clockwise direction (the closing direction), but not in the clockwise direction (the opening direction). Gear 7 rotates around axle 13 in plane parallel to cheek plates 10 and 12.

FIG. 9 is a partial view of the top surface of cheek plate 10 showing upper surface 72 of cam shaft 16 positioned substantially in the center of key hole 67 drilled through cheek plate 10. As shown in FIG. 2, upper surface 72 of cam shaft 16 is in alignment with the top surface of cheek plate 10. An identical view, not shown, and description could be made of the relationship between cam shaft 16 and cheek plate 12. Key hole 67 enables an individual to rotate cam 5 by use of an appropriate device such as the key shown in FIGS. 10–13.

Figure 9A:
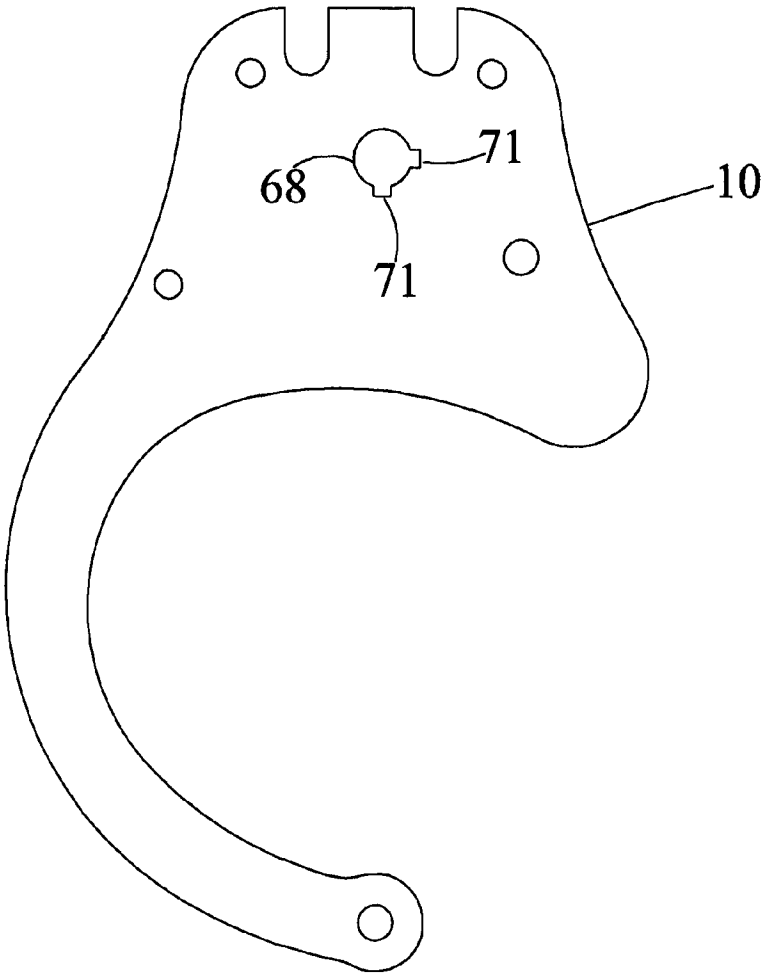
FIG. 9*a* is a plan view of an alternative to the key hole element shown in FIG. 9.
Figures 10, 11, 12, 13:
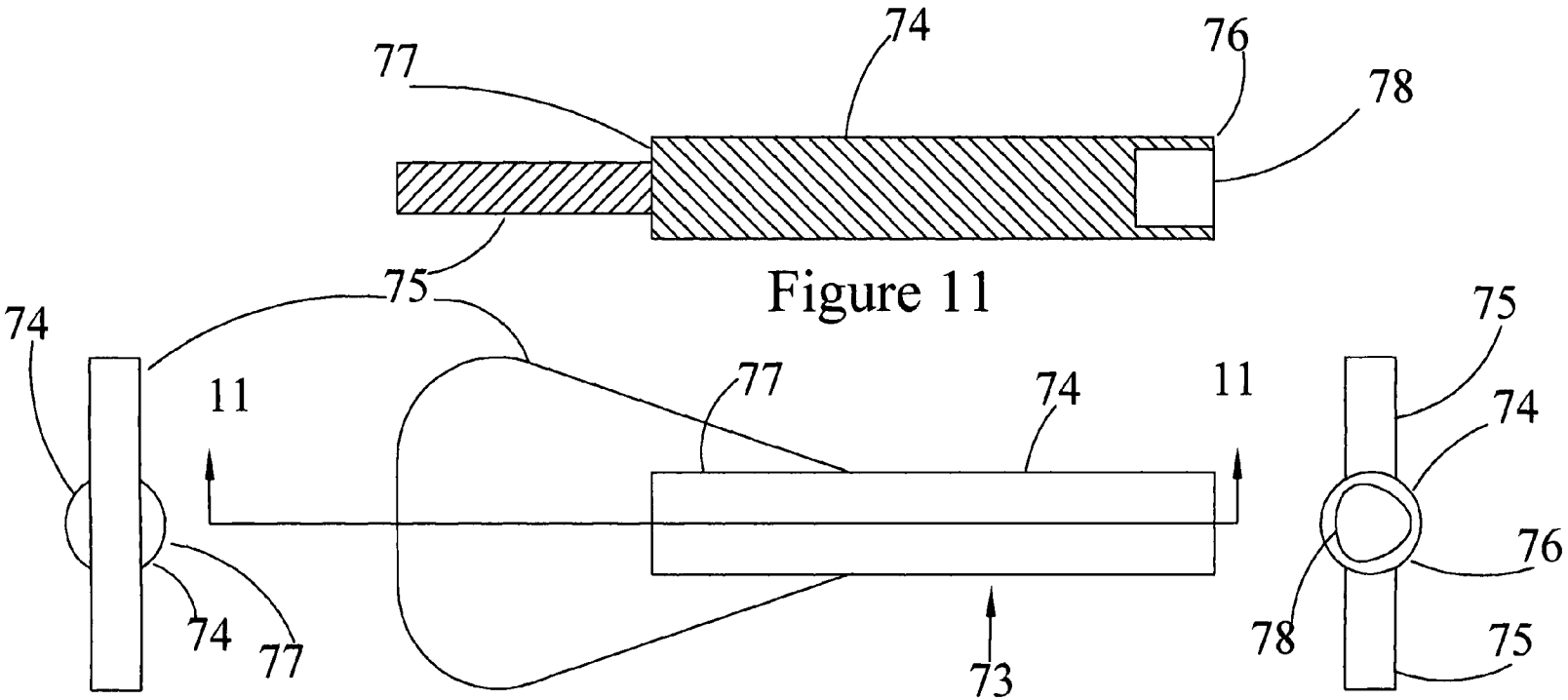
FIG. 10 is a side view of a key employed to rotate the rod cam shown in FIG. 7.
FIG. 11 is a section view of the key shown in FIG. 10 taken in the direction of cut line 11—11.
FIG. 12 is the bottom view of the key shown in FIG. 10.
FIG. 13 is the top view of the key shown in FIG. 10.
Figure 14:
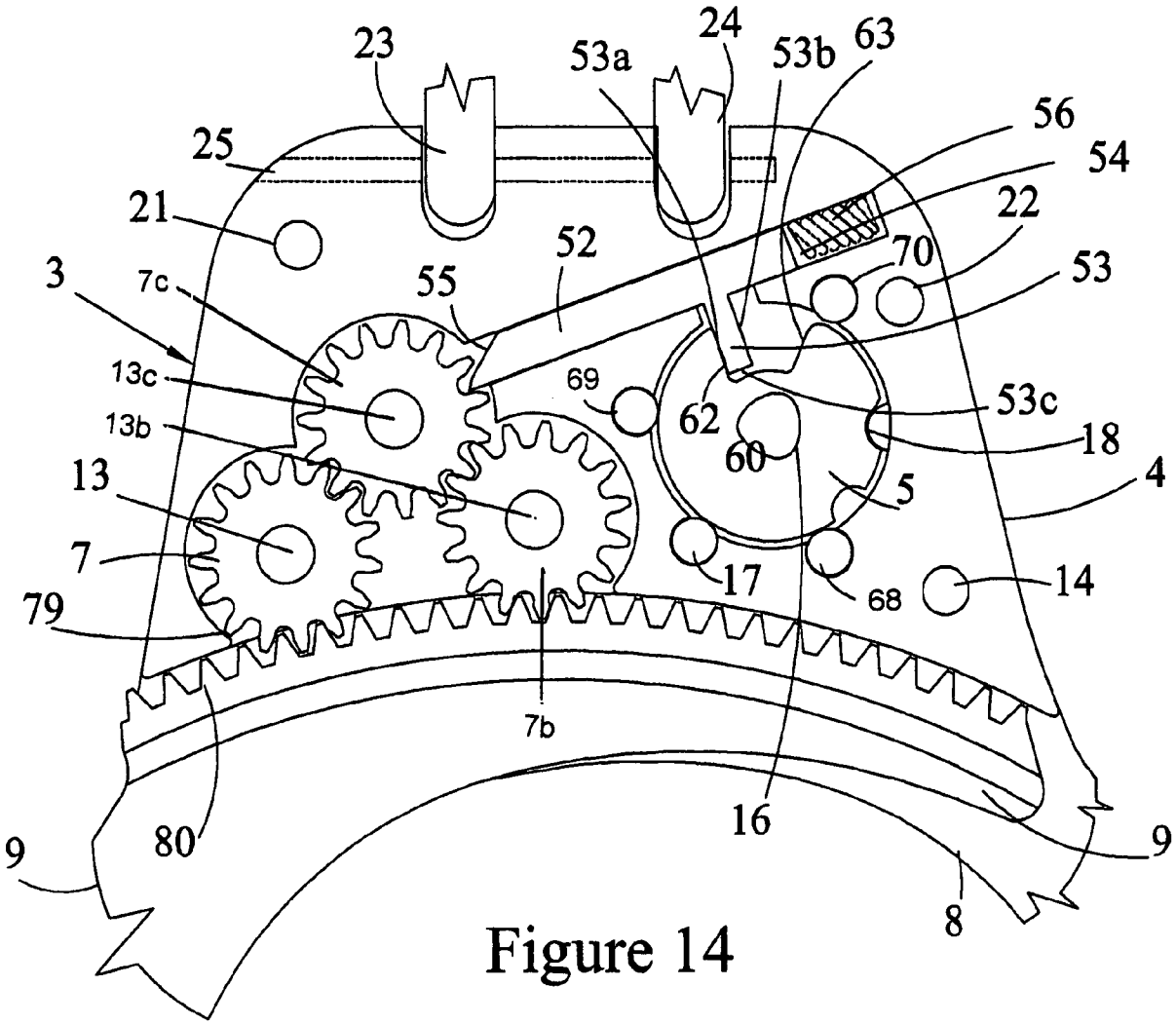
FIG. 14 is an enlarged view of the machinery space of an embodiment of a handcuff having three gears.

Key hole 67 is substantially circular, but the edge of key hole 67 can be smooth or irregular in shape. For example, an irregular edge can assume a saw-tooth shape, as illustrated in hole 67 of FIG. 9, or it can assume a shape having pockets or divots, as illustrated in hole 68 of FIG. 9*a*. Thus, continuous saw-teeth 70 are shown on the edge of hole 67, and spaced pockets 71 are shown on the edge of hole 68. An annulus space is formed between the edge of hole 67 and cam shaft 16. The top surface 60 and bottom surface 61 of cam plate 15 can be accessed by way of the annulus space.

It is believed that the irregular shape of the edge of key hole 67 will operate to prevent rotation of cam 5 with a device having a deformable surface. For example, a cylinder constructed of deformable plastic which can be softened, such as the barrel of a ball point pen, can be forced into a key hole of a cheek plate and over the shaft. The softened deformable material not only conforms to the shape of the shaft, but also conforms to the shape of the edge of the key hole. If the shape of the edge of the key is smooth, then the deformable material, upon hardening, can be used to rotate the cam, assuming that the deformed cylinder does not break. If the shape of the edge of the key hole is irregular, then the deformable material, upon hardening, cannot operate to rotate the cam in the opening direction, in the case of the saw-tooth edge, or in any direction, in the case of the pocket edge.

Key 73 for rotating cam 5 is shown in FIGS. 10, 11, 12 and 13. Key 73 is an article consisting of barrel 74 and handle 75. Barrel 74 is a solid circular cylinder having an operating end 76 and a handle end 77. The diameter of barrel 74 is less than the diameter of key hole 67. Closed axial hole 78 is formed in the end of operating end 76 to a depth at least equal to the distance between upper surface 72 of cam shaft 16 and top surface 60 cam plate 15. Axial hole 78 is shaped to slidably receive cam shaft 16. Accordingly hole 78 is triangular in shape, wherein the vertices of the triangle are curved lobes. The shape of hole 78 is identical to the horizontal cross section of shaft 16. Accordingly, barrel 74 does not rotate around shaft 16. Rotation of barrel 74 produces identical rotation of cam 5.

A longitudinal notch, not shown, is cut in handle end 77 of barrel 74. The notch is parallel to the longitudinal axis of barrel 74. The width of the notch is less than the diameter of barrel 74, but it is sufficiently wide to slidably receive handle 75. It is not required that handle 75 be rigidly fixed in the notch, but it must be sufficiently retained in the notch to enable rotational forces applied to handle 75 to be transferred to cam 5 by barrel 74.

OPERATION OF INVENTION

The operation of the handcuff of this invention involves placing rod cam 5 in three different positions—the closing position, the locked position and the opening position. FIGS. 1 and 3 show handcuff 2 in the closing position.

In the closing position: the bevel-shaped proximal end 55 of control pin 52 extends into gear cavity 33, wherein the slanted side of end 55 contacts teeth 79 of gear 7 which intermesh with teeth 80 of swing arm 9; control pin 52 is urged into cavity 33 by linear force exerted against distal end 54 of pin 52 by biasing spring 56; rod cam 5 is oriented in cavity 31, so that detent ball 18 is positioned in closing detent 59, and held therein by linear force exerted by biasing spring 19 against ball 18; and cam lever 53 of control rod 6 extends into cam lever slot 57, wherein free side 62 of slot 57 is contacted by free side 53*a* of cam lever 53.

In the closing position, rotation of cam 5 in cavity 31 is prevented by detent ball 18 in detent 59; rotation of swing arm 9 in the closing direction (clockwise) is enabled because gear 7 can rotate in the closing direction (counter clockwise), but rotation of swing arm 9 in the opening direction (counter clockwise) is prevented because gear 7 cannot rotate in the opening direction (clockwise). In this regard, when swing arm 9 is urged to rotate in the closing direction which, in consequence, urges gear 7 to rotate in the closing direction, linear force thus generated by contact between teeth 79 of gear 7 and the slanted side end 55 causes pin 52 to compress biasing spring 56 by an amount sufficient to permit gear 7 to rotate until a tooth 79 passes the slanted side. In contrast, when swing arm 9 is urged to rotate in the opening direction which, in consequence, urges gear 7 to rotate in the opening direction, no linear force is generated by contact between teeth 79 of gear 7 and the flat side end 55, accordingly, pin 52 does not compress biasing spring 56 to thereby prevent rotation of gear 7 and swing arm 9.

In the locked position: the bevel-shaped proximal end 55 of control pin 52 extends into gear cavity 33 wherein the slanted side of end 55 contacts teeth 79 of gear 7 which intermesh with teeth 80 of swing arm 9; control pin 52 is urged into cavity 33 by linear force exerted against distal end 54 of pin 52 by biasing spring 56; rod cam 5 is oriented in cavity 31, so that detent ball 18 is positioned in locking detent 58 and held therein by linear force exerted by biasing spring 19 against ball 18; and cam lever 53 of control rod 6 extends into cam lever slot 57, wherein locked side 63 of slot 57 is contacted by locked side 53*b* of cam lever 53.

In the locked position, rotation of cam 5 in cavity 31 is prevented by detent ball 18 in detent 59; rotation of swing arm 9 in any direction is prevented because gear 7 cannot rotate in any direction. In this regard, when swing arm 9 is urged to rotate in the closing direction which, in consequence, urges gear 7 to rotate in the closing direction, linear force thus generated by contact between teeth 79 of gear 7 and the slanted side of end 55 cannot cause pin 52 to compress biasing spring 56 because movement of pin 52 against spring 56 is prevented by contact between lever 53 and locked side 63 of slot 57. And as previously explained, when swing arm 9 is urged to rotate in the opening direction which, in consequence, urges gear 7 to rotate in the opening direction, no linear force is generated by contact between teeth 79 of gear 7 and the flat side end 55, accordingly, pin 52 does not compress biasing spring 56 to thereby prevent rotation of gear 7 and swing arm 9.

In the opening position, which is sometimes referred to as the free position: control pin 52 does not extend into gear cavity 33 and does not contact teeth 79 of gear 7 which intermesh with teeth 80 of swing arm 9; rod cam 5 is oriented in cavity 31, so that detent ball 18 is positioned against ramp 65 and held against ramp 65 by linear force exerted by biasing spring 19 against ball 18; and cam lever 53 of control rod 6 extends into cam lever slot 57, wherein free side 62 of slot 57 contacts free side 53*a* of cam lever 53 with force sufficient to move control rod 6 in slots 43 and 44 to cause distal end 54 of pin 52 to compress biasing spring 56.

In the opening position, rotation of cam 5 in cavity 31 is controlled, as hereafter explained by key 73; rotation of swing arm 9 in any direction is enabled because gear 7 can rotate in any direction. In this regard, swing arm 9 can rotate in any direction because rotation of gear 7 in any direction is not impeded by end 55 which does not contact teeth 79 of gear 7.

As described above, the operating status of the handcuff of this invention as being in one of the closing, locked or opening positions is based on the position of detent ball 18 with respect to closing detent 59, locking detent 58 or ramp 65, respectively. Rotation of rod cam 5 moves detents 59 and 58 and ramp 65 with respect to detent ball 18, which, of course, can only linearly slide within hole 38 in the space between cam space 31 and detent spring 19. Accordingly, cam plate 15 is rotated by placing axial hole 78 of key 73 over either end of shaft 16 of rod cam 5 and then manually turning barrel 74 of key 73 with handle 75 to position one of detents 59 and 58 and ramp 65 with respect to detent ball 18.

Manual turning force placed on handle 75 can be terminated when detent ball 18 is positioned in detent 58 or detent 59. In those positions, rod cam 5 is stable and will not rotate in the absence of applied manual force. In contrast, rod cam 5 is not stable and will rotate if turning force is terminated when detent ball 18 is positioned on ramp 65. In this regard, if manual turning force is terminated while ball 18 is on ramp 65, then rod cam 5 will automatically rotate to position ball 18 in detent 59. In short, the handcuff automatically reverts to closing position from opening position. The practical result is that manual force must be continually applied to rod cam 5 to maintain the handcuff in the opening position until no tooth of gear 7 is intermeshed with any tooth on swing arm 9.

Having described the invention, that which is claimed is:

1. An apparatus comprised of at least a first gear, a swing arm, a control rod, and a rod cam wherein:

said first gear is rotatably attached to a first axle which is perpendicularly affixed to a planar base, said first gear is adapted to rotate around said first axle in a plane parallel to said planar base and is equipped with a first set of teeth;

said swing arm is rotatably attached to said planar base and is adapted to rotate in a plane parallel to said planar base, said swing arm is equipped with a second set of teeth adapted for intermeshing contact with said first set of teeth;

said control rod is slidably mounted on said planar base, and is adapted to control the rotation of said first gear around said first axle;

said rod cam is comprised of a cam plate and a cam shaft, wherein said cam plate is substantially circular in shape, and includes a top surface, a bottom surface and shoulder means, said cam plate is rotatably positioned within a substantially circular cam space abutting said planar base and is adapted to rotate within said cam space in a plane parallel to said planar base, wherein said shoulder means is adapted to contact and cause said control rod to linearly slide on said planar base upon rotation of said cam plate, said cam shaft perpendicularly extends from said top surface and said bottom surface of said cam plate at the center of said cam plate through a key hole formed in said planar base and is adapted to cause said cam plate to rotate within said cam space.

2. An apparatus comprised of at least a first gear, a swing arm, a control rod, and a rod cam wherein:

said first gear is rotatably attached to a first axle which is perpendicularly affixed to a planar base, said first gear is adapted to rotate around said first axle in a plane parallel to said planar base and is equipped with a first set of teeth;

said swing arm is rotatably attached to said planar base and is adapted to rotate in a plane parallel to said planar base, said swing arm is equipped with a second set of teeth adapted for intermeshing contact with said first set of teeth;

said control rod is slidably mounted on said planar base, and is adapted to control the rotation of said first gear around said first axle;

said rod cam is comprised of a cam plate and a cam shaft, wherein said cam plate is substantially circular in shape, and includes a top surface, a bottom surface and shoulder means, said cam plate is rotatably positioned within a substantially circular cam space abutting said planar base and is adapted to rotate within said cam space in a plane parallel to said planar base, wherein said shoulder means is adapted to contact and cause said control rod to linearly slide on said planar base upon rotation of said cam plate and wherein said cam space is a first hole formed in a housing plate which is rigidly attached to said planar base; and said cam shaft perpendicularly extends at least from said top surface of said cam plate and is adapted to cause said cam plate to rotate within said cam space.

3. An apparatus comprised of at least a first gear, a swing arm, a control rod, and a rod cam wherein:

said first gear is rotatably attached to a first axle which is perpendicularly affixed to a planar base, said first gear is adapted to rotate around said first axle in a plane parallel to said planar base and is equipped with a first set of teeth;

said swing arm is rotatably attached to said planar base and is adapted to rotate in a plane parallel to said planar base, said swing arm is equipped with a second set of teeth adapted for intermeshing contact with said first set of teeth;

said control rod is slidably mounted on said planar base, and is adapted to control the rotation of said first gear around said first axle;

said rod cam is comprised of a cam plate and a cam shaft, wherein said cam plate is substantially circular in shape, and includes a top surface, a bottom surface and shoulder means, said cam plate is rotatably positioned within a substantially circular cam space abutting said planar base and is adapted to rotate within said cam space in a plane parallel to said planar base, wherein said shoulder means is adapted to contact and cause said control rod to linearly slide on said planar base upon rotation of said cam plate, said cam shaft perpendicularly extends at least from said top surface of said cam plate and is adapted to cause said cam plate to rotate within said cam space, wherein said cam shaft is adapted to receive a key to enable rotation of said rod cam.

4. The apparatus of claim 2 wherein said control rod is positioned in a slot formed in said housing plate.

5. The apparatus of claim 4 wherein said at least first gear is positioned in a cavity formed in said housing plate.

6. The apparatus of claim 2 wherein the diameter of said cam space is sized to substantially maintain the center of said cam plate in alignment with the center of said cam space.

7. The apparatus of claim 6 wherein said housing plate is penetrated by at least one dowel hole having a diameter less than the diameter of said cam space, wherein an edge of said dowel hole intersects an edge of said cam space.

8. The apparatus of claim 7 wherein a dowel is located in said dowel hole, wherein a portion of said dowel extends into said cam space and slidably contacts the perimeter of said cam plate.

9. The apparatus of claim 6 is a handcuff.

10. The apparatus of claim 7 is a handcuff.

11. The apparatus of claim 2 further comprised of a second gear rotatably attached to a second axle which is perpendicularly affixed to said planar base, said second gear is equipped with a third set of teeth and is adapted to rotate around said second axle in a plane parallel to said planar base;

said third set of teeth is adapted for intermeshing contact with said second set of teeth on said swing arm upon rotation of said second gear around said second axle.

12. The handcuff of claim 11 further comprised of a third gear rotatably attached to a third axle which is perpendicularly affixed to said planar base, said third gear is equipped with a fourth set of teeth and is adapted to rotate around said third axle in a plane parallel to said planar base;

said fourth set of teeth is adapted for intermeshing contact with said first set of teeth on said first gear and said third set of teeth on said second gear upon rotation of said first gear around said first axle and said second gear around said second axle.

13. The apparatus of claim 2 wherein said control rod is adapted to contact said first set of teeth on said first gear to control the rotation of said first gear around said first axle.

14. The apparatus of claim 1 wherein said cam shaft is adapted to receive a key from the top surface and the bottom surface of said cam plate.

* * * * *